US006145131A

United States Patent [19]

Huff

[11] Patent Number: 6,145,131

[45] Date of Patent: Nov. 14, 2000

[54] KNOTLESS ADJUSTABLE WRAP

[76] Inventor: Callie J. Huff, 76-7 Garden Cir., Waltham, Mass. 02154

[21] Appl. No.: 09/500,371

[22] Filed: Feb. 8, 2000

Related U.S. Application Data

[63] Continuation-in-part of application No. 09/201,210, Nov. 30, 1998, abandoned.

[51] Int. Cl.[7] ..... A42B 5/00

[52] U.S. Cl. ..... 2/207; 2/171

[58] Field of Search ..... 2/207, 69, 171, 2/171.8, 171.7, 171.4, 181, 181.2, 183, 174, 208, 209, 195.8, DIG. 11, 170, 311, 312, 338, 127, 133, 129–131, 137, 138, 140, 141.1, 141.2, 144–148, 155–157; 132/273–277, 141, 144; 24/615, 616, 625

[56] References Cited

U.S. PATENT DOCUMENTS 2,806,222 9/1957 Carpenter .
3,748,661 7/1973 Smith .
4,723,325 2/1988 Perry .
5,414,869 5/1995 Thomson .
5,621,921 4/1997 Outland .
5,636,384 6/1997 Draughon et al. .
5,826,598 10/1998 Meehan .
5,867,833 2/1999 LeDonne .
5,867,835 2/1999 Dabbieri .

*Primary Examiner*—Gloria M. Hale
*Attorney, Agent, or Firm*—Joseph R. Birkner

[57] ABSTRACT

A knotless adjustable wrap, which may be worn about the neck or head in a wide variety of styles, in which a continuous loop is formed from a blank of material. A first and a second collar are each slidably attached to the continuous loop in a spaced, cooperating relationship with each other and with the continuous loop. The first collar defines a first V portion disposed on one side of the continuous loop and the second collar defines a second V portion disposed on the opposite side of the continuous loop through which the continuous loop passes. The collars and V portions cooperate with each other and with the continuous loop when the first collar and the second collar independently move with respect to each other about the continuous loop for adjustably changing the size of the knotless adjustable wrap.

20 Claims, 6 Drawing Sheets

KNOTLESS ADJUSTABLE WRAP

CROSS REFERENCES TO RELATED APPLICATIONS

This application is a continuation-in part application claiming priority to U.S. application Ser. No. 09/201,210 filed Nov. 30, 1998 now abandoned.

FIELD OF THE INVENTION

This invention relates generally to a clothing accessory. More particularly, the present invention relates to a knotless adjustable wrap which is an all-in-one, size adjustable clothing fashion accessory garment suitable for use by both men and women. The knotless adjustable wrap has various uses and does not require knots, ties or pins and may be worn about the neck as well as about the head.

BACKGROUND OF THE INVENTION

Various clothing and garment accessories such as scarves, head bands and hat bands suitable for use by men, women and children for wearing about the neck as well as about the head have been available for many years. Such garments have been used as fashion accessories and are available in a wide variety of styles, designs, colors and shapes. Typically fashion scarves require tying, pining or knotting to keep them in place thereby making adjustments difficult to practically impossible to accomplish. Also, some scarves have holding mechanisms such as separate rings, clasps, clips or holders for maintaining them in a particular position when in use. One problem with scarves relying upon holding mechanisms for use is that if the holder is misplaced or lost, the scarf is unusable. This is frustrating and annoying to a user particular for busy people including travelers. Other scarves, headbands and hat bands are manufactured from odd geometric shapes which require complicated, hard to follow instructions for tying or for using such garments thereby making them of limited use despite the apparent intended uses that mention various shapes for which those garments may be manipulated. Products which require additional holding mechanisms and tying of knots become bulky, uncomfortable to the user and overwhelming. Some scarf manufacturers try to promote their products as hat bands and headbands but can not overcome the consumer's fear of tying and adjusting the material. Even if the size of the scarves are manufactured in smaller, less bulky sizes and styles, they still require education to the consumer about how to manipulate the material in order to obtain various shapes and are time consuming and inconvenient to use.

In view of the above mentioned problems and limitations associated with conventional fashion accessories, it was recognized by the present inventor that there is an unfulfilled need for an all-in-one improved knotless adjustable wrap, that can be readily manipulated by a user into a wide variety of shapes and styles. Such a wrap would be one that does not rely on knots, pins, or holding mechanisms such as separate rings, clasps, clips or holders for maintaining them in a particular position when in use.

Accordingly, it becomes clear that there is a great need for a fashion and highly functional and practical garment which has many uses. Such a garment should be one that is easy to use, is readily adjustable and is economically manufactured from a single piece of material.

SUMMARY OF THE INVENTION

It is therefore an object of this invention to provide a multi-purpose knotless adjustable wrap which does not rely on knots, pins, or holding mechanisms such as separate rings, clasps, clips or holders for maintaining a particular position when in use that avoids the aforementioned problems of prior art devices. Such a knotless adjustable wrap, which may be worn about the neck or head in a wide variety of styles, provides a continuous loop formed from a blank of material to which a first and a second collar are each slidably attached in a spaced, cooperating relationship with each other and with the continuous loop for adjustably changing the size of the knotless adjustable wrap.

It is another object of the present invention to provide an improved knotless adjustable wrap that can be readily fabricated from blank of a single piece of material with no waste.

It is another object of the present invention to provide an improved knotless adjustable wrap that can be formed of a single piece of material having a rectangular shape.

It is a further object of this invention to provide a knotless adjustable wrap which may be manufactured from readily available materials by conventional manufacturing processes.

Another object of this invention to provide a knotless adjustable wrap that is formed of a material chosen from the group consisting of natural and synthetic cloth fabric materials which are joined, by sewing.

It is also an object of this invention to provide a knotless adjustable wrap that is convenient, practical, low cost, all-in-one multi-purpose that can be readily manipulated by a user into a wide variety of shapes and styles.

It is still a further object of this invention to provide a knotless adjustable wrap that is simple in design, simple to manufacture, low in cost and is easy and fun to use.

This invention results from the realization that there is a great need for a knotless adjustable wrap, particularly a knotless adjustable wrap which may be worn about the neck or head and be easily manipulated by a user into a wide variety of shapes and styles which does not rely on knots, pins, or holding mechanisms.

The resulting invention provides a user the capability of conveniently being able to use the all-in-one multi-purpose knotless adjustable wrap for different occasions without the need to purchase separate scarves, head bands, hat bands, or article holders thereby saving time and money.

The above and the other objects are achieved in accordance with the present invention, which, according to a first aspect, provides a knotless adjustable wrap, which may be worn about the neck or head in a wide variety of styles, in which a continuous loop is formed from a blank of material. The blank has a first end and a second end parallel to the first end, a first edge and a second edge parallel to the first edge, both edges extending longitudinally between the first and the second ends of the blank. A first collar having a first collar open end and a second collar having a second collar open end are each disposed on the first and on the second ends of the blank, respectively. Both collars are each slidably attached to the continuous loop in a spaced, cooperating relationship with each other and with the continuous loop. The first collar defines a first V portion disposed on one side of the continuous loop and the second collar defines a second V portion disposed on the opposite side of the continuous loop through which the continuous loop passes. The collars and V portions cooperate with each other and with the continuous loop when the first collar and the second collar independently move with respect to each other about the continuous loop for adjustably changing the size of the knotless adjustable wrap.

The second aspect is a special case of the first aspect of this invention with additional features.

According to a second aspect of the invention, disclosed is a knotless adjustable wrap which has a continuous loop formed from a blank of a single piece of material having a rectangular shape with the material chosen from the group consisting of natural and synthetic cloth fabric materials. The blank is longitudinally twisted at an angle in the range of about zero to 360 degrees. The collars and V portions cooperate with each other and with the continuous loop when the first collar and the second collar independently move with respect to each other about the continuous loop for adjustably changing the size of the knotless adjustable wrap within a range, dependent upon and a function of the dimensional size of said blank, extending between a short loop of about 5 inches (13 cm) condensed and a long loop of about 22 inches (56 cm) in diameter expanded where the ratio of long loop size to short loop size is about 5 to 1.

According to a third aspect of the invention, a method for making a knotless adjustable wrap is disclosed in accordance with the teachings of this invention.

DETAILED DESCRIPTION OF PREFERRED EMBODIMENTS

Figure 1:
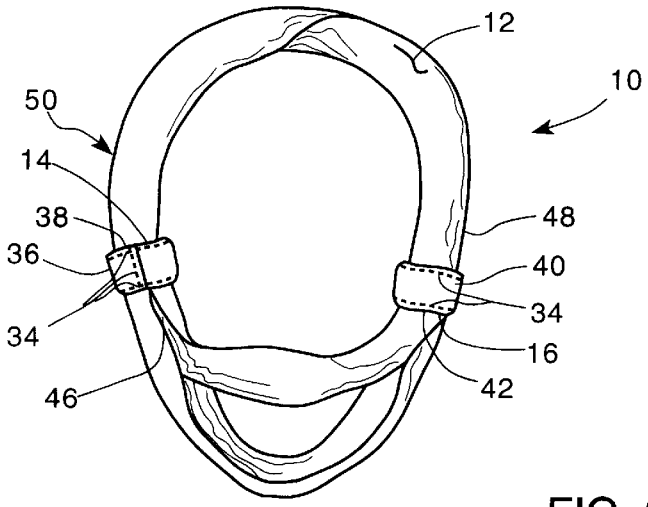
FIG. 1 is a front elevation view of a preferred embodiment of a knotless adjustable wrap of the instant invention.
Figure 2:
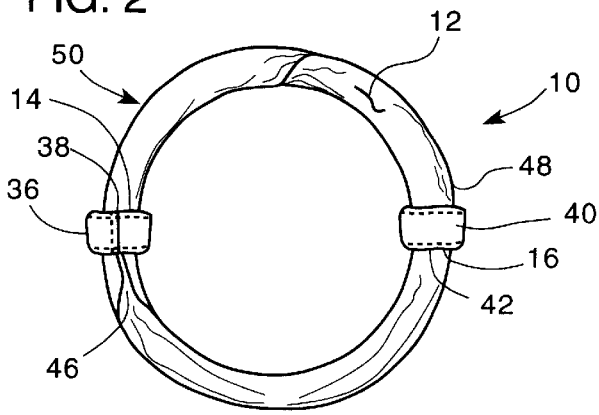
FIG. 2 is a front elevation view of a preferred embodiment of a knotless adjustable wrap of the instant invention showing the wrap adjusted to define a short loop.
Figure 3:
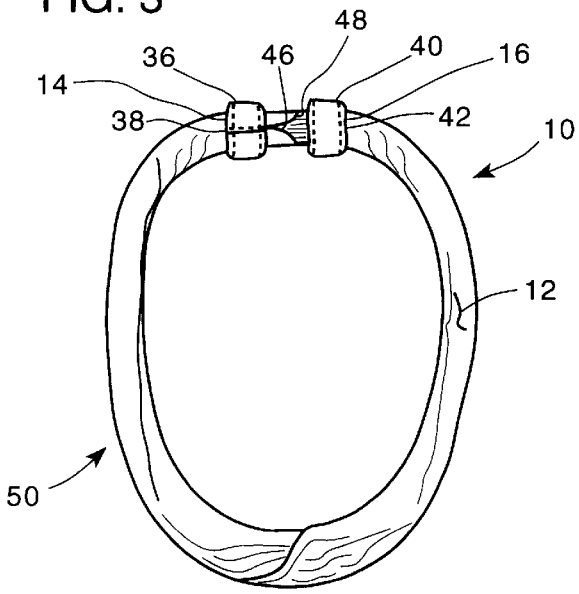
FIG. 3 is a front elevation view showing the wrap adjusted to define a long loop.

Looking more particularly to the drawings, there is shown in FIGS. 1–3 a preferred embodiment of a knotless adjustable wrap, which is generally indicated at 10, according to a preferred embodiment of the present invention.

Knotless adjustable wrap 10 is an all-in-one fashion accessory for use by women, men and children. The knotless adjustable wrap 10 allows a wide variety of styles and shapes to be created from the instant invention for many applications which are disclosed herein.

As shown in FIG. 1, knotless adjustable wrap 10 essentially comprises a blank 12, of a single piece of cloth fabric material, formed into a continuous loop 50 which is size adjustable without the use of knots, pins, or holding mechanisms such as separate rings, clasps, clips or holders. The continuous loop 50 has two collars slideably attached thereto; a first collar 36 having a first collar open end 38 and a second collar 40 having a second collar open end 42. The first collar 36 is created by sewing and stitching with a stitch 34 which defines a first V portion 46 through which a portion of the continuous loop 50 passes therethrough. The second collar 40 is also created by sewing and stitching at assembly, to complete the fabrication of the knotless adjustable wrap 10, with the stitch 34 which defines a second V portion 48, similar to the first V portion 46, disposed on an opposite side the continuous loop 50 through which another portion of the continuous loop 50 passes therethrough. The size of the knotless adjustable wrap 10 may be adjusted simply by appropriate sliding manipulation of the collars 36,40 along the continuous loop 50 until the desired style of the knotless adjustable wrap 10 is obtained.

As seen in FIGS. 2 and 3, size adjustments range from a short loop shown in FIG. 2 to a long loop shown in FIG. 3 and sizes therebetween as generally indicated in FIG. 1, for the knotless adjustable wrap 10, are possible to suit any particular fashion need or style for various uses. FIG. 2, a front elevation view of a preferred embodiment of the knotless adjustable wrap 10 of the instant invention, shows the wrap adjusted to define a short loop with collars 36,42 positioned midway on the continuous loop 50. FIG. 3 is a front elevation view showing the knotless adjustable wrap 10 adjusted to define a long loop with collars 36,42 positioned close together on the continuous loop 50.

Fabrication of the knotless adjustable wrap 10 is best understood by turning to FIGS. 4–13.

Figure 4:
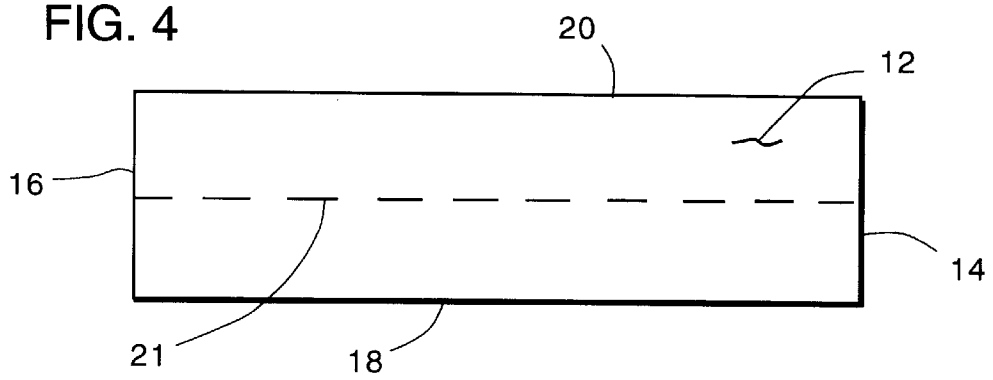
FIG. 4 is a front elevation view of a blank of material.

FIG. 4 is a front elevation view of the blank 12 comprising of a single piece of cloth fabric material of a single thickness layer from which the knotless adjustable wrap 10 is economically fabricated with no material waste. Although blank 12 may be of any convenient dimension, preferably the blank 12 may be made from a rectangular shape having approximate dimensions ranging from about 25 to 40 inches (64 to 102 cm) in length and ranging from about 1 to 7 inches (3 to 18 cm) in width for convenience and for conventional use. The blank 12 has a first end 14, a second end 16, parallel to and spaced from the first end 14; a first edge 18 extending longitudinally from and orthogonal to the first and second ends 14,16; a second edge 20 parallel to and spaced from the first edge 18 and orthogonal to the first and second ends 14,16; and, a longitudinally extending median fold line disposed between the ends 14,16 as indicated by dashed line 21. The material may, preferably, be fabricated from practically any suitable commercially available natural or synthetic fabric such as, but not limited to, nylon, cotton, silk, corduroy, wool, velvet, felt, chiffon, polyester, polychiffon, rayon, terri-cloth, micro suede, suede, leather, canvas, denim and, although not necessary, water repellent and elastomeric materials may also be used. The material may be selected from various colors or printed or embroidered patterns to suit the taste of a user.

Figure 5:
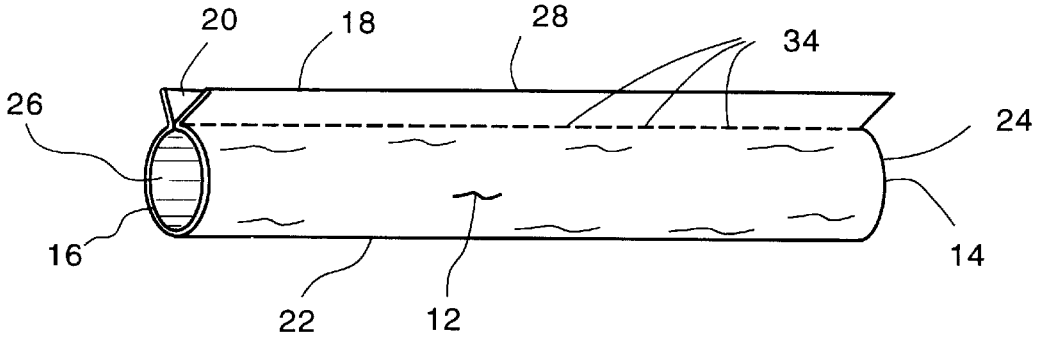
FIG. 5 is a perspective view of the blank of FIG. 4 after folding and stitched longitudinally along median fold line to define a seam and to create a tube.

FIG. 5 is a perspective view of the blank 12 of FIG. 4 after folding longitudinally along median fold line as indicated by dashed line 21 of FIG. 4 to define a seam 28 when the first edge 18 and the second edge 20 are joined with the stitch 34 applied near the edges thereby creating a tube 22 having a first open tube end 24 and a second open tube end 26.

Figure 6:
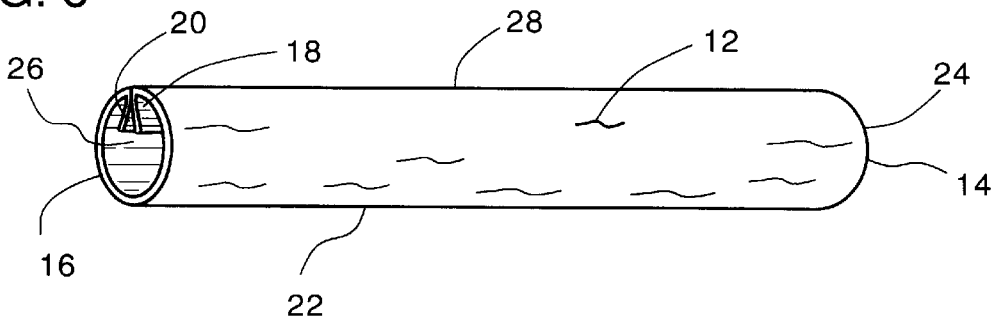
FIG. 6 is a perspective view of the tube of FIG. 5 after the blank was turned inside-out so that the longitudinal stitching is hidden inside the tube and is not visible from the exterior surface of the tube and only the seam is showing.

FIG. 6 is a perspective view of the tube 22 of FIG. 5 after the blank 12 was turned inside-out by passing the first end 14 through the first open tube end 24 along the interior longitudinal length of the tube 22 and through the second open tube end 26 so that the longitudinal stitching is hidden inside the tube 22 and is not visible from the exterior surface of the tube 22 and only the seam 28 is showing.

Figure 7:
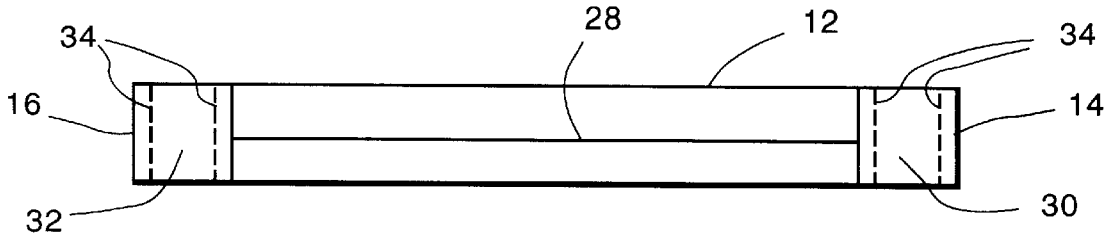
FIG. 7 is a front elevation view of the tube of the blank of FIG. 6 showing a first and a second hem with stitches on each end of the tube.

FIG. 7 is a front elevation view of the tube of the blank 12 of FIG. 6 showing a first hem 30 and a second hem 32 with stitches on the first end 14 and on the second end 16 of the tube 22 of FIG. 6 collapsing and thereby closing the tube openings 24,26 and essentially flattening the tube 22. Preferably, the hems 30,32 have two rows of stitches and indicated by the stitch 34 to provide a stiffer portion for later fabrication. It is understood that a single row of stitches could also be used. The first hem 30 and the second hem 32 may be doubled by folding onto each other prior to stitching and may also contain an elastomeric material for improved rigidity.

Figure 8:
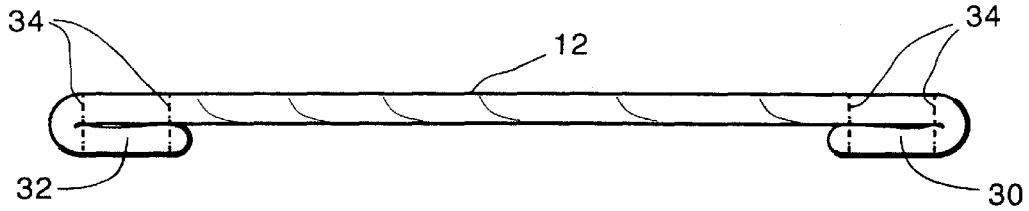
FIG. 8 is a top plan view of the formed blank of FIG. 7.

A top plan view of the formed blank 12 of FIG. 7 is shown in FIG. 8.

Figure 9:
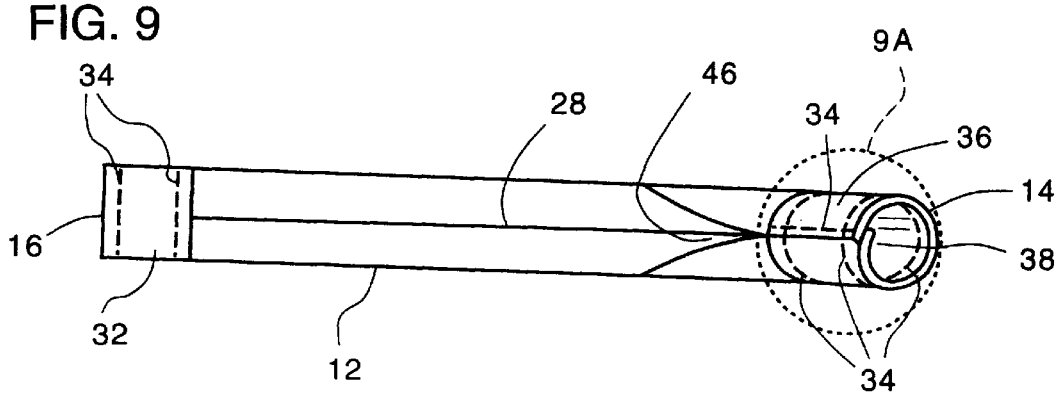
FIG. 9 is a perspective view showing a first collar formed on a first end of the blank.
Figure 9A:
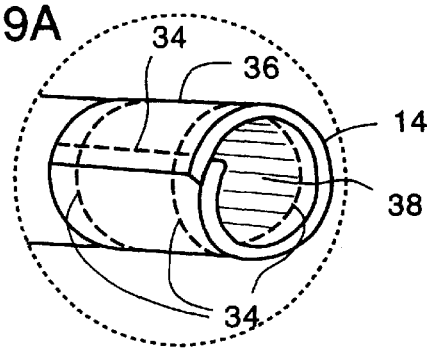
FIG. 9A is a perspective view showing a detailed view of the first collar of FIG. 9.

FIG. 9 is a perspective view showing the first collar 36 formed on the first end 14 of the blank 12 and FIG. 9A is a perspective view showing a detailed view of the first collar 36 of FIG. 9. First collar 36 is formed on the first end 14 of the blank 12 by rolling and overlapping the fabric material of the first hem 30 into a circular section in the form of the first collar 36 having the first collar open end 38 and by stitching together circumferentially and orthogonally to the circumferential stitches in a longitudinal direction parallel to the seam 28 as indicated by the stitch 34.

Figure 10:
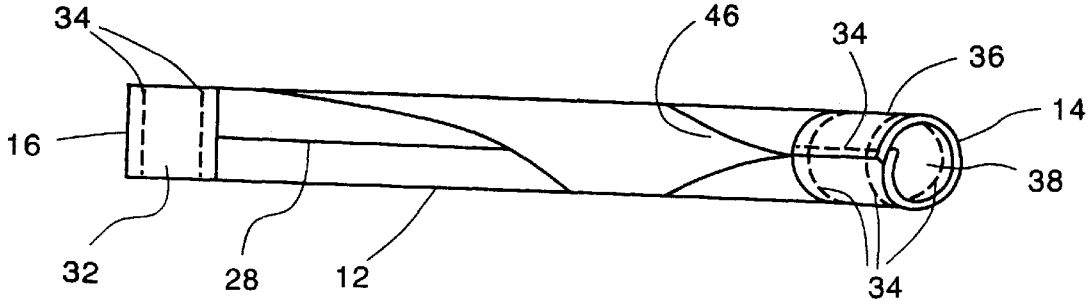
FIG. 10 is a perspective view of the material blank of FIG. 9 showing the material twisted through an angle of approximately 360 degrees.

To create the knotless adjustable wrap 10, the material of the blank 12 of FIG. 9, as shown in a perspective view of the blank 12 in FIG. 10, preferably is twisted through an angle of approximately 360 degrees, for style. It is understood that the material of the blank 12 may be twisted through an angle of between about zero and 360 degrees without departing from this disclosure.

Figure 11:
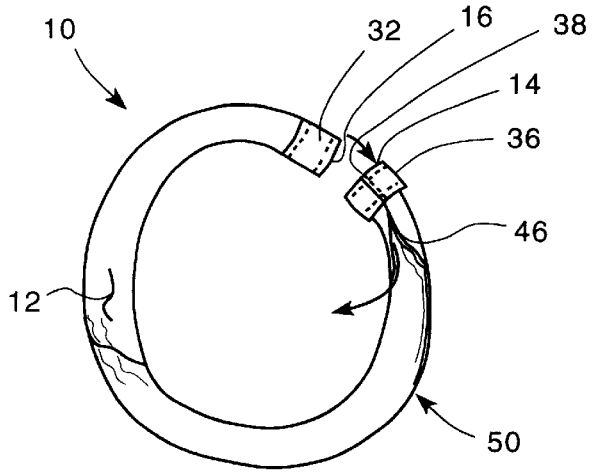
FIG. 11 is a front elevation view showing a second end with a second hem of the blank ready to be fed through the first collar open end of the first collar in a direction as indicated by the arrows.

FIG. 11 is a front elevation view showing the second end 16 of the blank 12 with the second hem 32 of the material of the blank 12 ready to be fed through the first collar open end 38 of the first collar 36 in a direction as indicated by the arrows. The second end 16 of the blank 12 with the second hem 32 of the material of the blank 12 is compressed a sufficient amount during assembly to fit into and to freely pass through the first collar open end 38 of the first collar 36 and through the first V portion 46.

Figure 12:
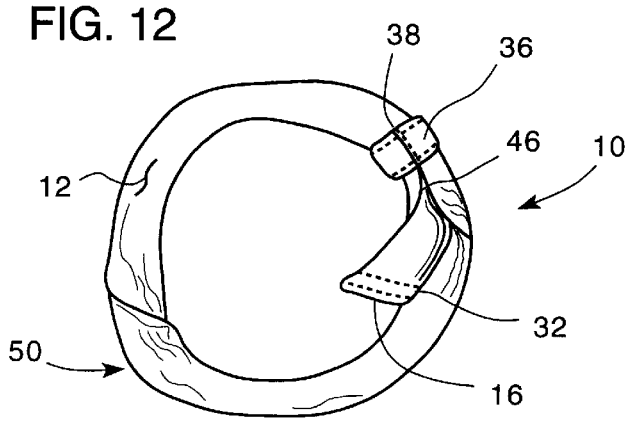
FIG. 12 is a front elevation view showing the second hem of FIG. 11 passed through the first collar and through the first V portion.
Figure 13:
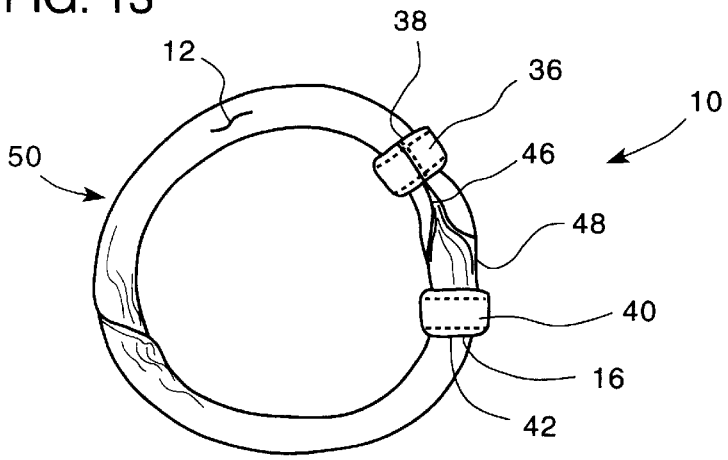
FIG. 13 is a front elevation view showing the second hem of FIG. 12 passed through the first collar and stitched at assembly to slideably attach it to a continuous loop.

FIG. 12 is a front elevation view showing the second hem 32 of the material of the blank 12 of FIG. 11 passed through the first collar 36 and through the first V portion 46 a sufficient amount and ready to be slideably attached to loop 50 as shown in FIG. 13.

The final fabrication and assembly of the knotless adjustable wrap 10 is shown in FIG. 13 which is a front elevation view. The second hem 32 of FIG. 12 is stitched by sewing at assembly to define the second collar 40 to slideably attach it to an opposite side of the continuous loop 50 as previously discussed above in connection with FIG. 1, thereby completing the assembly of the knotless adjustable wrap 10. The second collar 40 is constructed identically to the first collar 36 as previously mentioned and as shown in FIG. 9A.

In use, the instant invention, is configured into a wide variety of styles depending upon the particular need of the user. This is accomplished by simply independently manipulating the collars 36,40 in cooperation with each other and with the continuous loop 50 by moving the collars 36,40 around the continuous loop 50 until the desired style and shape is obtained for a chosen application. A few representative, but not all of the many variations and uses inherently provided by use of the instant invention, are illustrated in FIGS. 14–19 with the subject and article illustrated in phantom.

Figure 14:
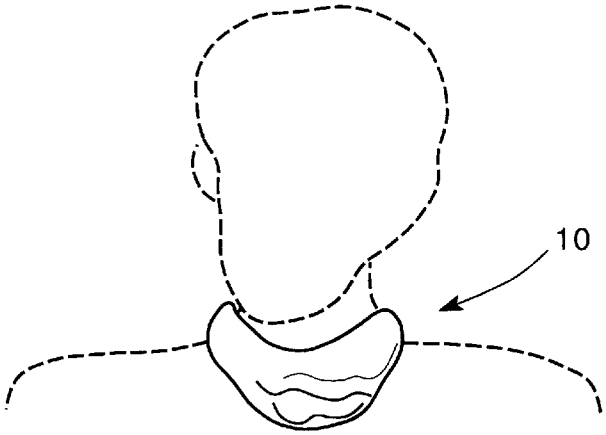
FIG. 14 illustrates the knotless adjustable wrap worn about the neck as a choker with the subject illustrated in phantom.

FIG. 14 illustrates the knotless adjustable wrap 10 worn about the neck as a choker.

Figure 15:
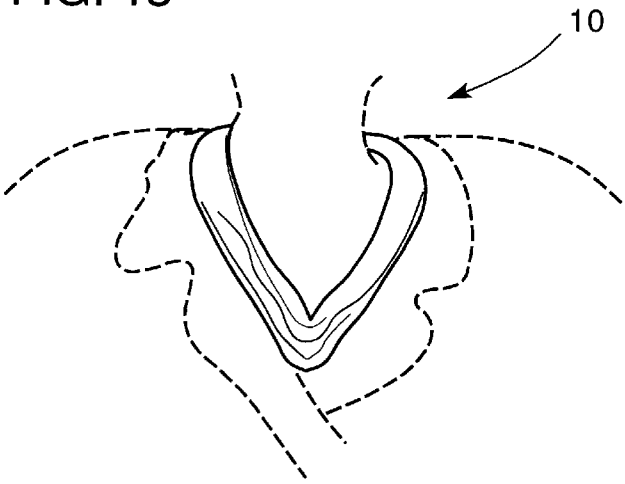
FIG. 15 illustrates the knotless adjustable wrap worn about the neck as a V-shape with the subject illustrated in phantom.

FIG. 15 illustrates the knotless adjustable wrap worn 10 about the neck as a V-shape.

Figure 16:
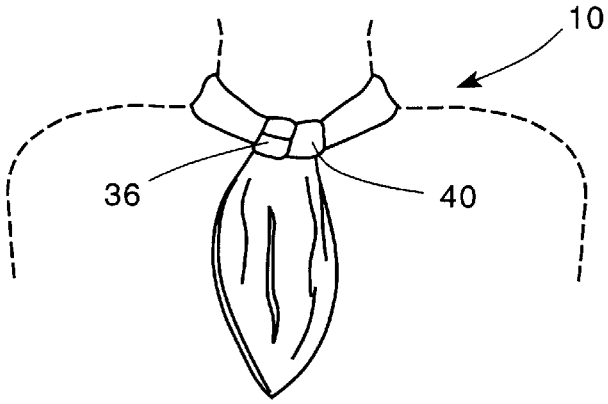
FIG. 16 illustrates the knotless adjustable wrap worn about the neck as a T-Shape with the subject illustrated in phantom.

FIG. 16 illustrates the knotless adjustable wrap 10 worn about the neck as a T-Shape.

Figure 17:
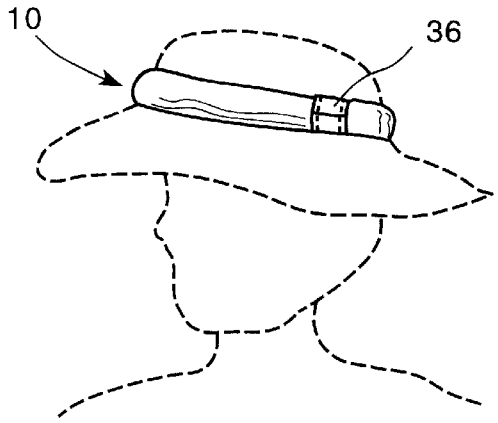
FIG. 17 illustrates the knotless adjustable wrap worn about a hat as a hat band with the subject illustrated in phantom.

FIG. 17 illustrates the knotless adjustable wrap worn 10 about a hat as a hat band.

Figure 18:
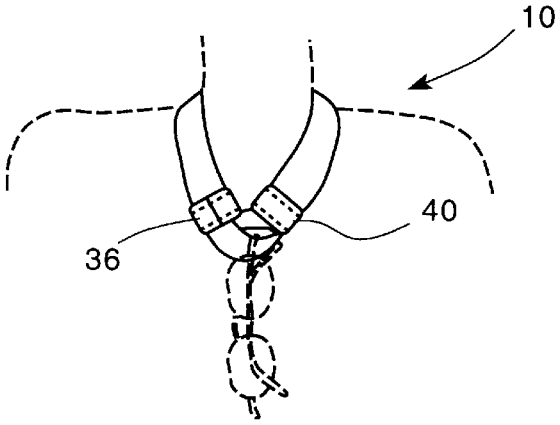
FIG. 18 illustrates the knotless adjustable wrap worn about the neck as an article holder such as for eyeglasses or sunglasses with the subject and article illustrated in phantom.

FIG. 18 illustrates the knotless adjustable wrap 10 worn about the neck as an article holder such as for eyeglasses or sunglasses. Other articles (not shown) such as, but not limited to, key chains, lockets, chains, pouches, bags and coin purses may be conveniently and securely held by the instant invention.

Figure 19:
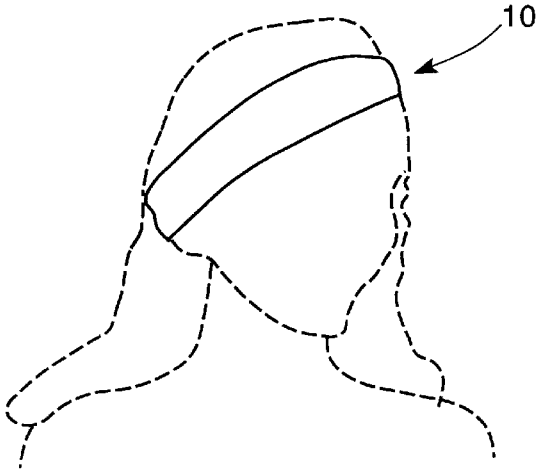
FIG. 19 illustrates the knotless adjustable wrap worn about the head as a head band with the subject illustrated in phantom.

FIG. 19 illustrates the knotless adjustable wrap 10 worn about the head as a head band. The knotless adjustable wrap 10 may also hold a pony-tail style hairdo and other hair styles in place.

Preferably, the knotless adjustable wrap 10 may be fabricated from readily available natural or from synthetic fabric materials as previously discussed, by conventional fabrication techniques, such as by sewing. It is understood that the collars 36,40 may also be partially formed and joined to the continuous loop 50 with hook and loop type fasteners, snaps and buttons instead of being completely sewn. Also, the collars 36,40 could be fabricated with additional stiffener inserts constructed from elastomeric or plastic material. Also, additional folds of fabric material for further reinforcement may be employed, as needed. This could be done by folding the hems 30,32 of FIG. 7 in half to create a thicker portion by folding the ends 14,16 in a manner to create, in effect, a double thickness hem rather than the single hem shown in FIG. 8.

The knotless adjustable wrap 10 may be constructed in a wide variety of sizes and style variations and may also have artistic decorations and color and patterns thereon and may be adapted for other uses besides the representative configurations and applications described herein without departing from the scope of this disclosure. For example, the all-in-one universal instant invention may also find use as a belt, as a belt attachment, as an arm sling and may also be used on animals.

One practical advantage of the invention is that it provides an unfulfilled need for an efficient, convenient, practical, low cost, all-in-one multi-purpose and versatile knotless adjustable wrap 10 that can be readily manipulated by a user into a wide variety of shapes and styles.

Another advantage of the invention is that the knotless adjustable wrap 10 is designed for ease of manufacture by standard methods by using readily available materials.

A further advantage of the present invention is that it can be readily fabricated from a single piece of material with no waste.

Still a further advantage is that the knotless adjustable wrap 10 does not rely on knots, pins, or holding mechanisms such as separate rings, clasps, clips or holders for maintaining a particular position when in use.

Of course, a wide variety of further uses and advantages of the present invention will become apparent to one skilled in the art.

As disclosed, it is apparent that the instant invention can provide use for other applications other than those disclosed herein. One skilled in the art will realize that the foregoing discussion outlines the more important features of the invention to enable a better understanding of the instant invention and to instill a better appreciation of the inventor's contribution to the art. It must be clear that the disclosed details of construction, descriptions of geometry and illustrations of inventive concepts are mere examples of possible manifestations of the invention.

Although the invention has been shown and described with reference to certain preferred embodiments, those skilled in the art undoubtedly will find alternative embodiments obvious after reading this disclosure. With this in mind, the following claims are intended to define the scope of protection to be afforded the inventor, and those claims shall be deemed to include equivalent constructions insofar as they do not depart from the spirit and scope of the present invention.

What is claimed is:

1. A knotless adjustable wrap comprising:

a continuous loop formed from a blank of material;

said blank having a first end and a second end parallel to said first end, a first edge and a second edge parallel to said first edge, both said edges extending longitudinally between said first and said second ends of said blank;

a first collar having a first collar open end;

a second collar having a second collar open end;

said first collar disposed on said first end of said blank and said second collar disposed on said second end of said blank;

said first collar and said second collar each slidably attached to said continuous loop in a spaced, cooperating relationship with each other and with said continuous loop;

said first collar defining a first V portion disposed on one side of said continuous loop and said second collar defining a second V portion disposed on the opposite side of said continuous loop through which said continuous loop passes and, said collars and said V portions cooperating with each other and with said continuous loop when said first collar and said second collar independently move with respect to each other about said continuous loop for adjustably changing the size of said knotless adjustable wrap.

2. The knotless adjustable wrap of claim 1 wherein said blank is formed of a single piece of material having a rectangular shape.

3. The knotless adjustable wrap of claim 2 wherein said knotless adjustable wrap is formed of a material chosen from the group consisting of natural and synthetic cloth fabric materials.

4. The knotless adjustable wrap of claim 3, wherein a tube having a first open tube end and a second open tube end is defined when said blank is folded about a median fold line and said first edge and said second edge of said blank are joined with a stitch longitudinally applied near said edges to create a seam.

5. The knotless adjustable wrap of claim 4 wherein said stitch applied longitudinally is hidden inside said tube and is not visible from an exterior surface of said tube and only said seam is showing when said blank is turned inside-out by passing said first end of said blank through said first open tube end along an interior longitudinal length of said tube and through said second open tube end.

6. The knotless adjustable wrap of claim 5 wherein a first hem and a second hem each disposed on, and having said stitch applied in at least one row adjacent to, said first end and said second end of said blank so that said openings of said tube are closed with said stitch.

7. The knotless adjustable wrap of claim 6 wherein said first collar is formed on said first end of said blank when said first hem is rolled in a circular overlapping manner to define said first collar and said first collar open end and to create said first V portion when said stitch is applied in a longitudinal direction parallel to said seam of said blank.

8. The knotless adjustable wrap of claim 7 wherein said blank is longitudinally twisted at an angle in the range of about zero to 360 degrees.

9. The knotless adjustable wrap of claim 8 wherein said second hem of said second end of said blank passes through both said first open collar end of said first collar and said first V portion of said blank.

10. The knotless adjustable wrap of claim 9 wherein said second hem of said second end of said blank defines said second collar and said second collar open end and creates said second V portion when said stitch completes attachment to said continuous loop at assembly.

11. The knotless adjustable wrap of claim 10 wherein said first collar and said second collar disposed on said first end and on said second end of said blank are stiffer and more rigid than said continuous loop to conveniently allow said continuous loop to readily pass therethrough.

12. The knotless adjustable wrap of claim 10 wherein said continuous loop is adjustably sized to define a range, dependent upon and a function of the dimensional size of said blank, extending between a short loop of about 5 inches (13 cm) condensed and a long loop of about 22 inches (56 cm) in diameter expanded, where the ratio of long loop size to short loop size is about 5 to 1.

13. The knotless adjustable wrap of claim 10 wherein said continuous loop is adjustably sized to be worn about the neck and to provide a knotless adjustable wrap chosen from the group consisting of a choker, a V-shape, a T-shape and an article holder.

14. The knotless adjustable wrap of claim 10 wherein said continuous loop is adjustably sized to be worn about a hat as a hat band.

15. The knotless adjustable wrap of claim 10 wherein said continuous loop is adjustably sized to be worn about the head as a head band.

16. A knotless adjustable wrap comprising:

a continuous loop formed from a blank of a single piece of material having a rectangular shape;

said material chosen from the group consisting of natural and synthetic cloth fabric materials;

said blank having a first end and a second end parallel to said first end, a first edge and a second edge parallel to said first edge, both said edges extending longitudinally between said first and said second ends of said blank;

a first collar having a first collar open end;

a second collar having a second collar open end;

said first collar disposed on said first end of said blank and said second collar disposed on said second end of said blank, said blank is longitudinally twisted at an angle in the range of about zero to 360 degrees;

said first collar and said second collar each slidably attached to said continuous loop in a spaced, cooperating relationship with each other and with said continuous loop;

said first collar defining a first V portion disposed on one side of said continuous loop and said second collar defining a second V portion disposed on the opposite side of said continuous loop through which said continuous loop passes and, said collars and said V portions cooperating with each other and with said continuous loop when said first collar and said second collar independently move with respect to each other about said continuous loop for adjustably changing the size of said knotless adjustable wrap within a range, dependent upon and a function of the dimensional size of said blank, extending between a short loop of about 5 inches (13 cm) condensed and a long loop of about 22 inches (56 cm) in diameter expanded where the ratio of long loop size to short loop size is about 5 to 1.

17. The knotless adjustable wrap of claim 16 wherein said first collar and said second collar disposed on said first end and on said second end of said blank are stiffer and more rigid than said continuous loop to conveniently allow said continuous loop to readily pass therethrough.

18. The knotless adjustable wrap of claim 17 wherein said first collar and said second collar are reinforced by folding a first and a second hem in half thereby doubling their thickness and sewing said hems with said stitch to create a thicker portion.

19. The knotless adjustable wrap of claim 17 wherein said first collar and said second collar are reinforced with elastomeric material.

20. A method for making a knotless adjustable wrap comprising the steps of:

providing a blank of material for creating a continuous loop therefrom wherein said continuous loop having a first collar and a second collar each slidably attached to said continuous loop in a spaced, cooperating relationship with each other and with said continuous loop;

said blank having a first end and a second end parallel to said first end, a first edge and a second edge parallel to said first edge, both said edges extending longitudinally between said first and said second ends of said blank;

forming a tube having a first open tube end and a second open tube end when said blank is folded about a median fold line and said first edge and said second edge of said blank are joined with a stitch longitudinally applied near said edges to create a seam;

passing said first end of said blank through said first open tube end, along an interior longitudinal length of said tube and through said second open tube end so that said stitch applied longitudinally is not visible from an exterior surface of said tube and only said seam is showing when said blank is turned inside-out;

closing said openings of said tube with said stitch when said first hem and said second hem each have said stitch applied in at least one row adjacent to said first end and adjacent to said second end of said blank;

forming said first collar on said first end of said blank by rolling said first hem in a circular overlapping manner to define said first collar and a first collar open end and to create a first V portion when said stitch is applied in a longitudinal direction parallel to said seam of said blank;

twisting said blank longitudinally at an angle in the range of about zero to 360 degrees;

feeding said second hem of said second end of said blank through said first open collar end of said first collar and through said first V portion of said blank;

forming said second collar on said second end of said blank by rolling said second hem in a circular overlapping manner to define said second collar and a second collar open end and to create a second V portion;

attaching said second collar to said continuous loop, during assembly, by applying said stitch in a longitudinal direction parallel to said seam of said blank allowing said second collar to be slidably attached to said continuous loop so that said second V portion is disposed on the opposite side of said continuous loop with respect to said first V portion;

moving said first collar and said second collar independently of each other about said continuous loop; and, passing said continuous loop through said collar open ends and through the opposing said V portions for adjustably changing the size of said knotless adjustable wrap.

* * * * *